US005871099A

United States Patent [19]

Mellenthin et al.

[11] Patent Number: 5,871,099

[45] Date of Patent: Feb. 16, 1999

[54] INTERACTIVE PACKAGING ASSEMBLY AND METHOD OF FORMING

[75] Inventors: Jess A. Mellenthin, Oxford, N.C.; Bernard Simms, Sandy Hook, Conn.

[73] Assignee: Black & Decker Inc., Newark, Del.

[21] Appl. No.: 781,093

[22] Filed: Jan. 9, 1997

[51] Int. Cl.[6] ..... B65D 77/02

[52] U.S. Cl. ..... 206/781; 206/320; 206/471

[58] Field of Search ..... 206/320, 349, 206/461, 464, 470, 471, 485, 485.1, 521, 769, 775, 779–782

[56] References Cited

U.S. PATENT DOCUMENTS

| | | | |
|---|---|---|---|
| D. 217,131 | 4/1970 | Shreve et al. . | |
| D. 219,334 | 12/1970 | Shreve et al. . | |
| D. 228,122 | 8/1973 | Shreve et al. . | |
| D. 249,467 | 9/1978 | Jones et al. . | |
| D. 249,639 | 9/1978 | Hogg et al. . | |
| D. 278,125 | 3/1985 | Benham . | |
| D. 278,126 | 3/1985 | Benham . | |
| D. 320,934 | 10/1991 | Cross et al. . | |
| D. 375,682 | 11/1996 | Ruben . | |
| 2,134,375 | 10/1938 | Price et al. . | |
| 2,217,455 | 10/1940 | Price et al. . | |
| 2,570,946 | 10/1951 | Hennessey . | |
| 3,239,127 | 3/1966 | Spencer . | |
| 3,298,504 | 1/1967 | Carter . | |
| 3,481,453 | 12/1969 | Shreve et al. . | |
| 3,487,922 | 1/1970 | Peck . | |
| 3,874,500 | 4/1975 | Nicholl . | |
| 3,891,088 | 6/1975 | Huebner . | |
| 3,946,870 | 3/1976 | Gejer et al. . | |
| 3,949,868 | 4/1976 | Allen . | |
| 4,165,805 | 8/1979 | Fethke et al. . | |
| 4,669,610 | 6/1987 | Lindsey . | |
| 4,779,734 | 10/1988 | Kydonieus | 206/780 |
| 4,804,091 | 2/1989 | Segal . | |
| 4,848,577 | 7/1989 | Hoffman et al. | 206/471 |
| 4,899,877 | 2/1990 | Kieman . | |
| 4,905,822 | 3/1990 | Bosco | 206/775 |
| 5,188,222 | 2/1993 | Pierce . | |
| 5,375,700 | 12/1994 | Joss . | |
| 5,447,230 | 9/1995 | Gerondale | 206/470 |
| 5,582,293 | 12/1996 | Kay | 206/775 |

*Primary Examiner*—Paul T. Sewell
*Assistant Examiner*—Luan K. Bui
*Attorney, Agent, or Firm*—Kerry H. Owens

[57] ABSTRACT

A packaging arrangement for a product enables a potential purchaser to view and handle the product while it is protected from damage and wear. The packaging arrangement includes a carton having cutout portions for displaying the product and an insert formed in the shape of the product. The carton and plastic insert together form a handle around the handle of the product. In order to assemble the packaging, the product is placed inside of the carton and the insert is placed around the product and inside of the carton. The top of the carton is then sealed leaving a strip to form a handle portion overlying the handle of the product.

17 Claims, 5 Drawing Sheets

INTERACTIVE PACKAGING ASSEMBLY AND METHOD OF FORMING

BACKGROUND

1. Field of the Invention

The invention relates to display containers for displaying items for sale. More particularly, the invention relates to packaging that allows a potential purchaser to view and handle the product to be purchased while the product is disposed within the packaging.

2. Background of Related Art

Various carton designs are present in the art for allowing a potential purchaser to view and/or handle a product.

U.S. Pat. Nos. 2,570,946 and 3,239,127 disclose cartons for irons. The cartons are structured such that frequent handling will not cause damage to the cartons or to the irons.

U.S. Pat. No. 3,874,500 discloses a display package for a tool that includes an open carton for supporting a tool enclosed by a transparent shrink-wrap.

U.S. Pat. No. 4,848,577 discloses a blister pack frame and assembly for displaying an article of merchandise.

U.S. Pat. No. 4,899,877 discloses a package for a tool that displays the tool and allows manual digital access to the tool.

U.S. Pat. No. 5,375,700 discloses a package for displaying cutlery that allows the consumer to touch and feel the handle without removing the item.

SUMMARY OF THE INVENTION

An object of the invention is to provide packaging for a product which enables the user to handle and view the product and is capable of fully supporting the product.

In an embodiment of the invention, a package for a product having a predetermined shape including a handle portion is provided. The package includes a translucent or transparent insert for encasing the product. The plastic insert is formed by front and rear sections that are formed in the shape of the product to be packaged such that the plastic insert has a gripping portion for encasing the handle. The package also comprises a carton for housing the translucent or transparent insert. The carton includes a bottom portion, side portions, front and rear panels, and a top portion. Each of the front and rear panels of the carton comprises cutout portions for allowing viewing and handling of the product to be packaged. The top portion of the carton comprises cutout portions that form a strip shaped to cover a top of the handle portion, thereby allowing gripping of the handle portion.

In an additional embodiment, the invention comprises a packaged product. The product comprises a base portion and a handle portion. The package includes a translucent or transparent insert encasing the product and a carton for housing the insert. The insert comprises a front section connected with a rear section. Both sections are formed in the shape of the product including a gripping portion for encasing the handle. The carton comprises a bottom portion, side portions, front and rear panels, and a top portion, wherein each of the front and rear panels comprises cutout portions for allowing viewing and handling of the product. The top portion comprises cutout portions to form a strip shaped to cover the top of the handle portion, thereby allowing gripping of the gripping portion.

Additionally, a method for packaging a product is disclosed. The method includes forming a carton having two side portions, front and back panels, and a bottom portion. The product is then loaded into the box and a translucent or transparent insert is placed around the product. The insert has a front section and a back section. The front section is placed adjacent the front panel of the carton and the back section is adjacent the back panel of the carton. The carton is then sealed such that the insert is trapped within the carton by forming a top portion of the carton with a handle portion.

In a preferred embodiment, and as shown in the accompanying drawings, the packaging of the invention is used in conjunction with an iron.

BRIEF DESCRIPTION OF THE DRAWINGS

The features of the invention are more fully disclosed in the following description, taken in conjunction with the accompanying drawings, wherein.

DETAILED DESCRIPTION OF THE INVENTION

Figure 1:
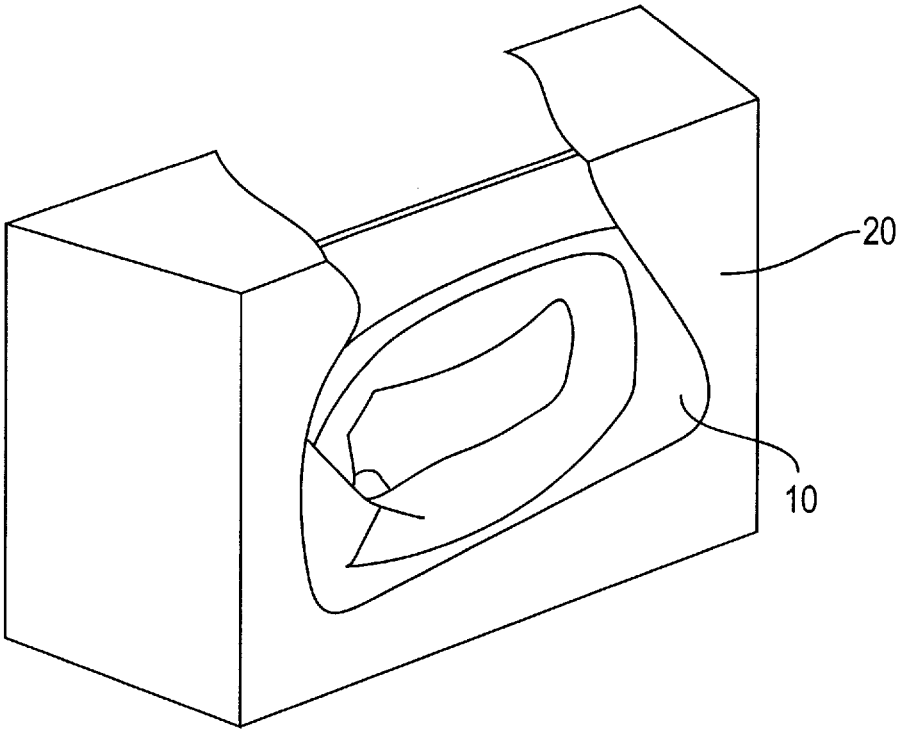
FIG. 1 is a perspective view of an embodiment of the invention in which an iron package is fully assembled.

FIG. 1 shows an assembled package of the invention in an embodiment in which the package houses an iron. A translucent or transparent insert 10 is formed in the shape of an iron and is placed around the iron within carton 20. Carton 20 has cutout portions, as described in more detail in reference to FIG. 4, which allow a potential purchaser to view and handle the product.

Figure 2:
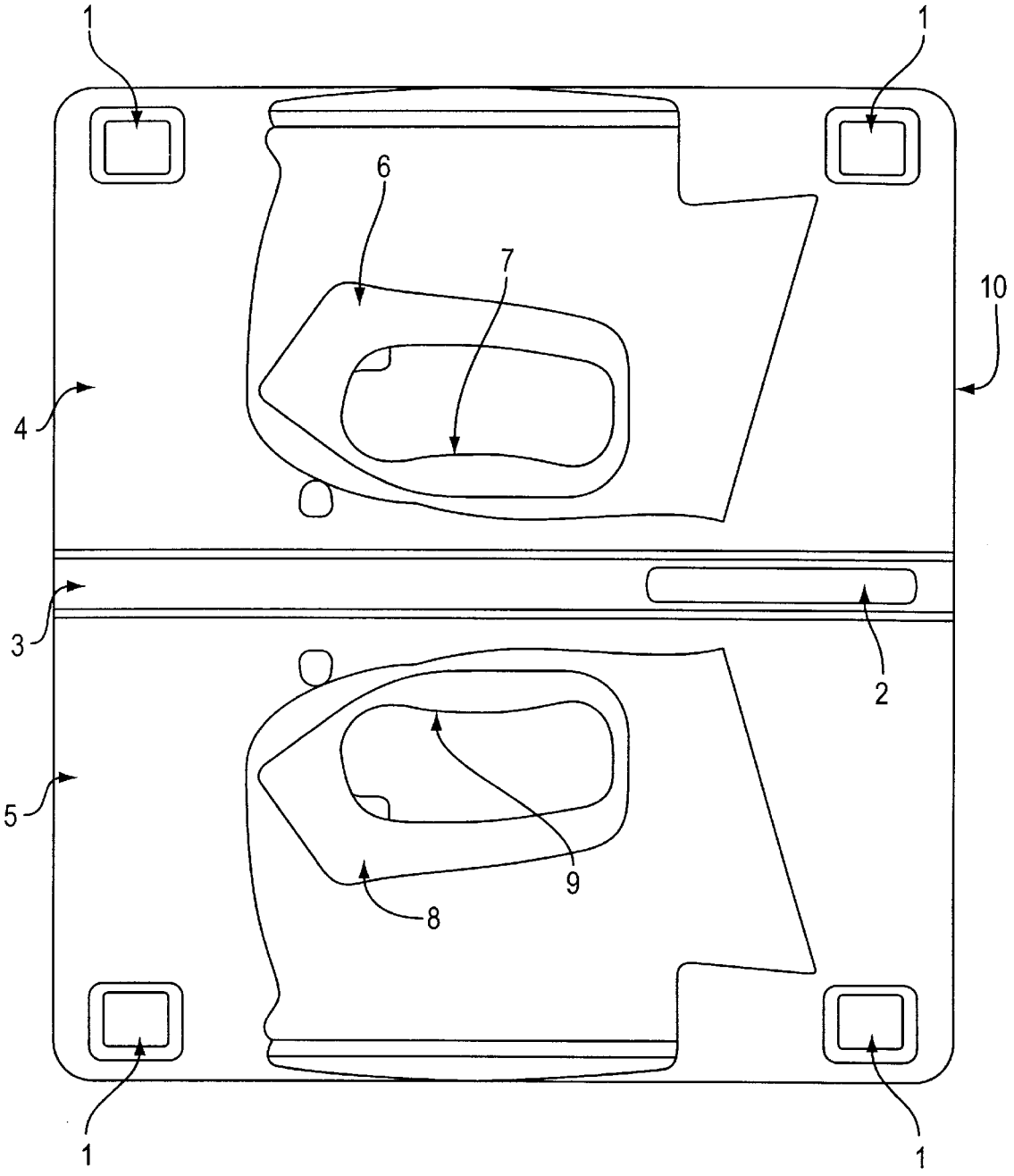
FIG. 2 is a top view of an embodiment of the plastic insert.
Figure 3:
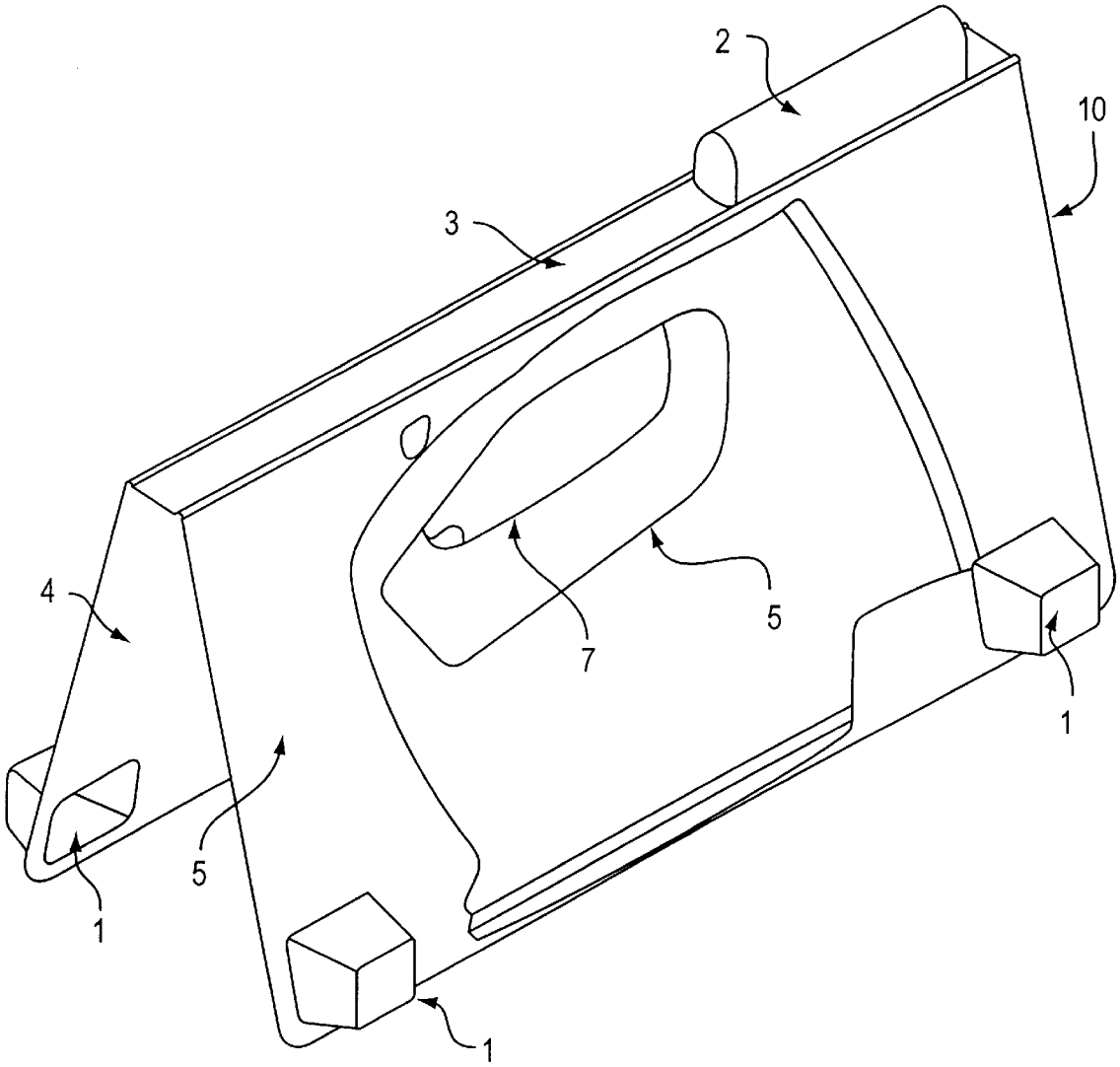
FIG. 3 is a perspective view an embodiment of the plastic insert in its operative position.

The translucent and transparent insert is disclosed in more detail with reference to FIGS. 2 and 3. FIG. 3 is a top plan view which shows an insert having first section 4 and second section 5. The sections are connected via hinged portion 3. Two protrusions 1 are formed on each of sections 4 and 5. The protrusions assist in positioning the insert 10 within carton 20. A protrusion 2 on hinged portion 3 also helps to position the insert. Handle portion 7 on first section 4 and handle portion 9 on second section 2 are formed to conform to the shape of the product handle. Base portion 6 on the first section and base portion 8 on the second section are shaped to conform to the shape of the base of the displayed product.

The translucent or transparent insert is preferably made from moldable plastics. The plastic may be Polyvinylchloride (PVC), but may be made from any other suitable material. The insert preferably allows light to pass through so that a potential purchaser may view the encased product. The insert prevents those handling the product from causing excessive wear. The insert is preferably thermoformed into the shape of the product to be displayed.

FIG. 3 illustrates the translucent or transparent insert in the position in which it is placed in the carton to encase the product to be displayed.

Figure 4:
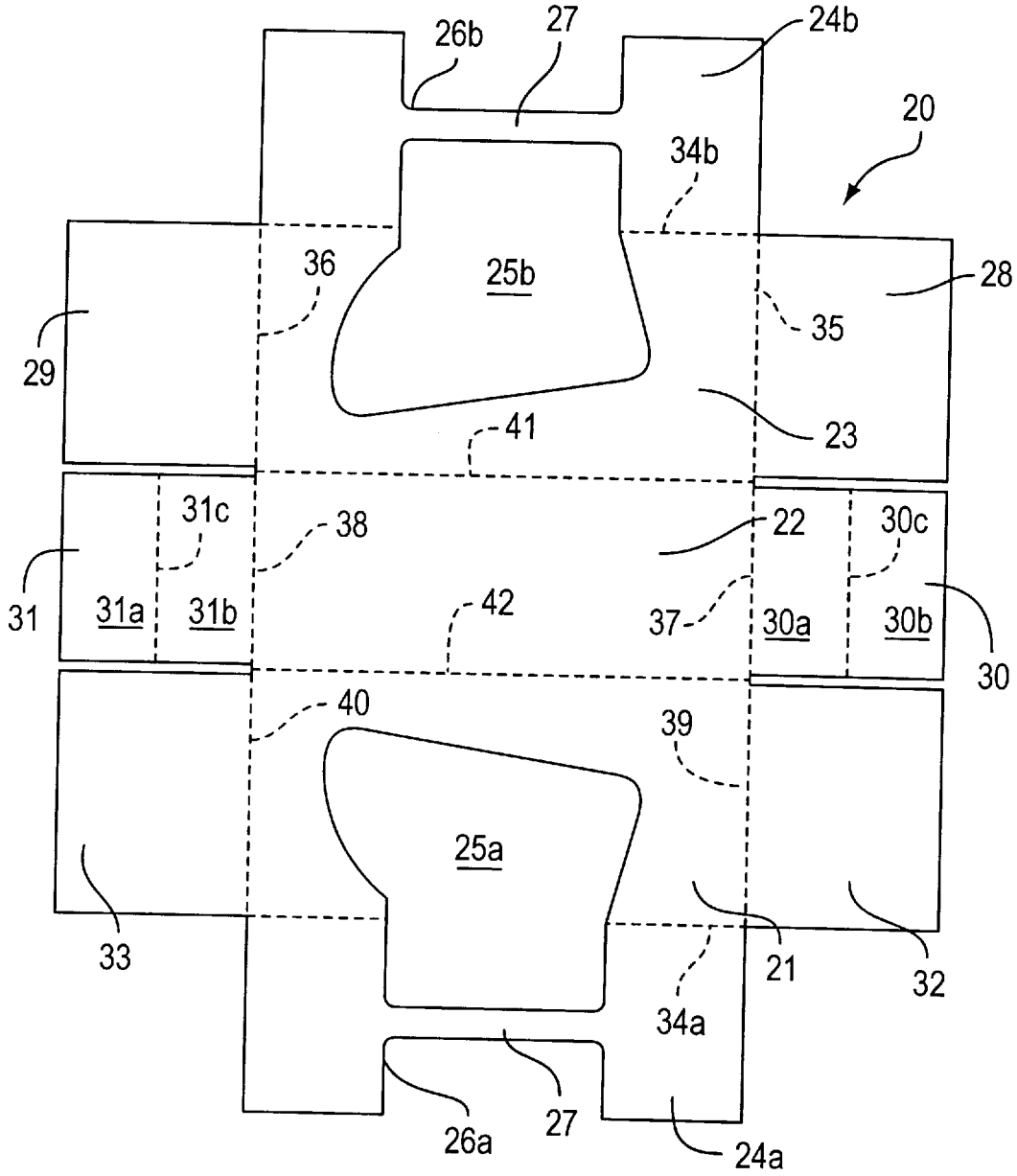
FIG. 4 is a top plan view of a carton of an embodiment of the invention.

FIG. 4 is a top plan view of the unassembled carton 20. The base of the carton 22 is defined between fold lines 37, 38, 41, and 42. Front and rear panels are designated 21 and 23. The front and rear panels are structurally identical to one another, but may be distinguished by printing different promotional materials on each side when the product is displayed. Each of the front and rear panels 21 and 23 also includes cutout portions 25*a* and 25*b*. Panel 21 is defined by fold lines 34*a*, 39, 40, and 42. Panel 23 is defined by fold lines 34*b*, 35, 36, and 41.

In the illustrated embodiment, panels 28–33 form the side portions of the box when assembled. Other configurations known to those skilled in the art may also be employed for constructing the side portions. In the illustrated embodiment, panel 28 is attached at fold line 35 to panel 23 and panel 29 is attached at fold line 36 to panel 23. Panel 33 is attached at fold line 40 to panel 21 and panel 32 is attached at fold line 39 to panel 21. Panels 30 and 31 are attached at fold lines 37 and 38 to the bottom portion 22 of the carton. Panel 31 is divided into two sections 30*a* and 30*b* by fold line 30*c*. Likewise, panel 31 is divided into two sections 31*a* and 31*b* by fold line 31*c*.

In the illustrated embodiment, the top portion of the carton is formed by panels 24*a* and 24*b*. Cutout portions 25*a* and 25*b* extend into panels 24*a* and 24*b* respectively. Along with cutout portions 26*a* and 26*b*, portions 25*a* and 25*b* form strip 27, which is located on the top portion of the box in its fully assembled position. The strip 27 directly covers the handle of the product to be displayed, thereby enabling gripping.

Figure 5:
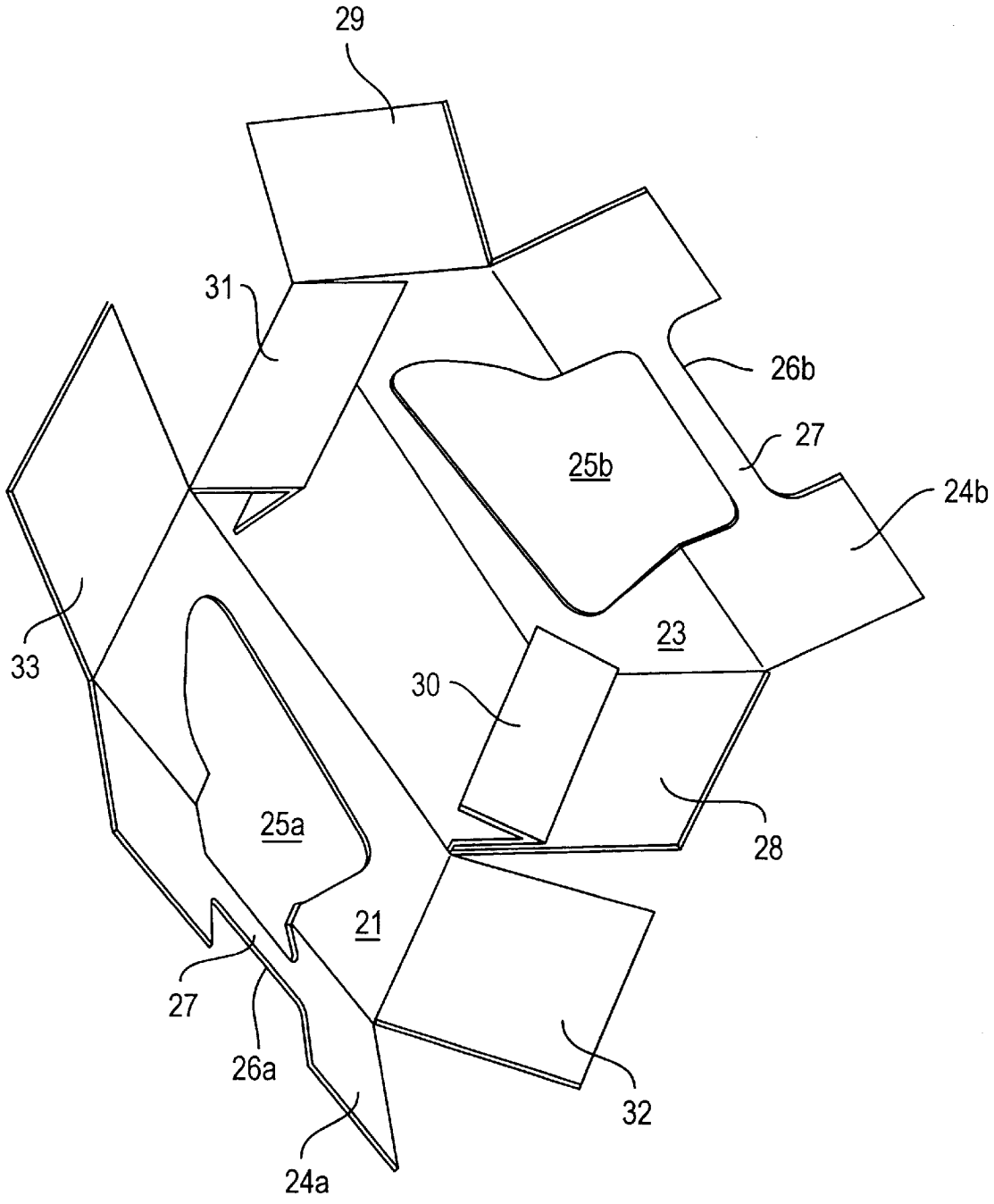
FIG. 5 is a perspective view of the carton in a partially assembled condition.

FIG. 5 shows the carton in a partially assembled configuration. Flaps 30 and 31 are folded and extend into the bottom portion of the box to assist in holding plastic insert 10 in place.

The carton is preferably constructed from cardboard, but may be formed with any material suitable for supporting the product and the insert.

Although in the illustrated embodiment, the product to be packaged is an iron, any product including a handle, such as power tools, hand tools, kitchen tools, etc., could be packaged with the packaging of the invention.

The method of packaging the product begins with the forming of the carton as shown in FIG. 5. The front and rear panels and side portions are assembled prior to setting the base of the iron inside the carton. The iron is then placed inside the carton. The translucent or transparent insert is secured over the iron. Protrusions 1 on translucent or transparent insert 10 ensure that the iron will be held in place within carton 20. Subsequently, the top portion of the carton is formed by folding over flaps 24*a* and 24*b* and sealing them to form handle strip 27.

The invention has been described in conjunction with specific embodiments thereof, which are intended to be illustrative, not limiting. Therefore, it is to be understood that various modifications can be made without departing from the spirit and scope of the invention as defined in the appended claims.

What is claimed is:

1. A package for a product having a predetermined shape including a handle portion, the package comprising:

a translucent or transparent insert for encasing the product, said insert comprising, a front section connected with a rear section, wherein the front and rear sections are formed into a shape of the product to be packaged such that said insert has a gripping portion for encasing the handle; and a carton for housing the insert, the carton comprising, a bottom portion, side portions, front and rear panels, and top portion, wherein the front and rear panels each comprise cutout portions for allowing viewing and handling of the product and the top portion comprises a cutout portion to form a strip shaped to cover a top of the handle portion, thereby allowing gripping of the handle portion.

2. The package of claim 1, wherein the insert comprises a hinged portion connecting the front section and the rear section of the plastic insert.

3. The package of claim 2, wherein the insert further comprises a protrusion on the hinged portion for abutting the top portion of the carton.

4. The package of claim 1, wherein the insert is plastic and is thermoformed in the predetermined shape.

5. The package of claim 1, wherein the insert further comprises two protrusions on the front section and two protrusions on the rear section for abutting respectively the front and rear panels of the carton.

6. The package of claim 1, wherein the each of the side portions of the carton has an inner portion comprising a hinged piece positioned to contact edges of the front and rear sections of the insert.

7. The package of claim 1, wherein the side portions of the carton each comprise a first panel connected with the rear panel of the carton and a second panel connected with the front panel of the carton.

8. The package of claim 1, wherein the top portion of the carton comprises a top panel connected with the front panel of the carton and a top panel connected with the rear panel of the carton.

9. The package of claim 8, wherein the top panels each include two cutout portions.

10. The package of claim 1, wherein the insert is shaped to accommodate an iron.

11. A packaged product, comprising:

a product having a base portion and a handle portion;

a translucent or transparent insert for encasing the product, said insert comprising, a front section connected with a rear section, wherein the front and rear sections are formed into a shape of the product such that said insert has a gripping portion for encasing the handle portion; and a carton for housing the insert, the carton comprising, a bottom portion, side portions, front and rear panels, and a top portion, wherein the front and rear panels each comprise cutout portions for allowing viewing and handling of the product and the top portion comprises a cutout portion to form a strip shaped to cover a top of the handle portion, thereby allowing gripping of the handle portion.

12. The packaged product of claim 11, wherein the insert comprises a hinged portion connecting the front section and the rear section.

13. The packaged product of claim 12, wherein the insert further comprises a protrusion on the hinged portion for abutting the top portion of the carton.

14. The packaged product of claim 11, wherein the insert is a plastic that is thermoformed in the predetermined shape.

15. The packaged product of claim 11, wherein the product comprises an iron.

16. The packaged product of claim 11, wherein each of the side portions of the carton has an inner portion comprising a hinged piece positioned to contact edges of the front and rear sections of the insert.

17. The packaged product of claim 11, wherein the side portions of the carton each comprise a first panel connected with the rear panel of the carton and a second panel connected with the front panel of the carton.

* * * * *